US010219540B2

(12) United States Patent
Brown et al.

(10) Patent No.: US 10,219,540 B2
(45) **Date of Patent: *Mar. 5, 2019**

(54) FILTER COMPONENTS, FILTERS, SMOKING ARTICLES, AND RELATED METHODS, ALL FOR THE CONTROLLED DELIVERY OF AEROSOLS

(71) Applicant: LORILLARD TOBACCO COMPANY, Greensboro, NC (US)

(72) Inventors: Steven E. Brown, Oak Ridge, NC (US); Luis A. Sanchez, Greensboro, NC (US); Kai Tang, Chapel Hill, NC (US); Suzanne F. Roof, Elon, NC (US)

(73) Assignee: LORILLARD TOBACCO COMPANY, Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/694,566

(22) Filed: Sep. 1, 2017

(65) Prior Publication Data

US 2017/0360085 A1 Dec. 21, 2017

Related U.S. Application Data

(62) Division of application No. 14/478,854, filed on Sep. 5, 2014, now Pat. No. 9,848,636.

(60) Provisional application No. 61/874,273, filed on Sep. 5, 2013.

(51) Int. Cl.

| | |
|---|---|
| ***A24D 3/04*** | (2006.01) |
| ***A24D 3/10*** | (2006.01) |
| ***A24D 3/14*** | (2006.01) |

(52) U.S. Cl.
CPC ..... *A24D 3/043* (2013.01); *A24D 3/045* (2013.01); *A24D 3/10* (2013.01); *A24D 3/14* (2013.01)

(58) Field of Classification Search
None
See application file for complete search history.

(56) References Cited

U.S. PATENT DOCUMENTS

| | | | |
|---|---|---|---|
| 4,054,550 | A | 10/1977 | Parker et al. |
| 4,109,666 | A | 8/1978 | Norman et al. |
| 4,362,171 | A | 12/1982 | Johnson et al. |
| 4,380,241 | A | 4/1983 | Horsewell |
| 4,942,887 | A | 7/1990 | Abdelgawad et al. |
| 4,972,853 | A | 11/1990 | Brackmann et al. |

(Continued)

OTHER PUBLICATIONS

International Search Report and Written Opinion in PCT/US2014/054370, dated Dec. 22, 2014, 8 pages.

(Continued)

*Primary Examiner* — Eric Yaary
(74) *Attorney, Agent, or Firm* — Folley & Lardner LLP

(57) ABSTRACT

A filter for a smoking article comprises a mouth end filter segment and a rod end filter segment. The rod end filter segment has a passage extending longitudinally therethrough. The passage has a diameter of about 1.0 mm or greater. In one embodiment, the rod end filter segment is comprised of an infinite pressure drop material. In another embodiment, the rod end filter segment is comprised of a low pressure drop material having a hollow tubular element disposed within to define the passage with an inner diameter greater than about 1.55 mm. Air dilution means are disposed in one of said filter segments to admit ventilating air into the filter.

19 Claims, 14 Drawing Sheets

(56) References Cited

U.S. PATENT DOCUMENTS

| | | | | |
|---|---|---|---|---|
| 5,396,910 | A | 3/1995 | Casey, III | |
| 5,435,326 | A | 7/1995 | Gentry et al. | |
| 8,235,057 | B2 | 8/2012 | Li et al. | |
| 8,240,315 | B2 | 8/2012 | Olegario et al. | |
| 2007/0186945 | A1 | 8/2007 | Olegario et al. | |
| 2008/0017204 | A1 | 1/2008 | Braunshteyn et al. | |
| 2008/0216851 | A1 | 9/2008 | Olegario et al. | |
| 2009/0301503 | A1 | 12/2009 | Peter et al. | |
| 2009/0314303 | A1* | 12/2009 | Awty | A24D 3/043 131/344 |
| 2011/0048436 | A1 | 3/2011 | Fiebelkorn | |
| 2012/0291792 | A1 | 11/2012 | Treadaway et al. | |

OTHER PUBLICATIONS

Non-Final Office Action in U.S. Appl. No. 14/478,854, dated Dec. 12, 2016, 8 pages.
Final Office Action in U.S. Appl. No. 14/478,854, dated Mar. 30, 2017, 10 pages.
Notice of Allowance in U.S. Appl. No. 14/478,854, dated Jul. 20, 2017, 8 pages.

* cited by examiner

| | Controls | | Protocols | | | |
|---|---|---|---|---|---|---|
| | 1 | 2 | A | B | C | D |
| Cigarette length (mm) | 80 | 100 | 85 | 80 | 100 | 100 |
| Filter length (mm) | 21 | 27 | 27 | 21 | 27 | 27 |
| Insert length (mm) | - | - | 17 | 5 | 20 | 12 |
| Mouth piece length (mm) | - | - | 10 | 16 | 7 | 15 |
| Pressure drop filter segment type | - | - | Very high pressure drop | Infinite pressure drop | Very high pressure drop | Infinite pressure drop |
| Pressure drop element material | | | Cellulose Acetate | Polyethylene | Cellulose Acetate | Polyethylene |
| Insert I.D. (mm) | - | - | 2.0 | 2.0 | 2.0 | 2.0 |
| Insert density (g/ml) | - | - | 0.16 | 0.12 | 0.17 | 0.17 |
| Mouth piece density (denier/1000 filament) | - | - | 3.3/35 | 1.8/42 | 1.8/42 | 3.3/35 |
| Ventilation hole location | - | - | High pressure drop segment | Mouth piece | High pressure drop segment | Mouth piece |
| Ventilation hole position (mm) | 13 | 13.5 | 15 | 13 | 20 | 13.5 |
| Air Ventilation (%) | 30 | 33 | 20 | 30 | 20 | 30 |
| Puff count (#) | 7 | 10 | 6 | 7 | 8 | 10 |
| TPM yield sum (first-to-last puff, mg/cig) | 10.4 | 12.8 | 10.0 | 9.4 | 9.4 | 12.9 |
| Tar consistency (Slope 2 to 8 puff, mg/(cig*puff)) | 0.15 | 0.11 | 0.035 | 0.016 | 0.0064 | -0.009 |

*FIG. 2*

| Filter Rod Attributes | Range | Preferred | Most Preferred |
|---|---|---|---|
| Circumference (mm) | 22 - 26 | 23.5 - 24.1 | 23.8 |
| Hollow I.D. tube (mm) | 0.5 - 3.0 | 1.0 - 2.5 | 2.0 |
| Length (mm) | 5 - 20 | 7 - 17 | 10 |
| Density (g/ml) | 0.8 - 0.01 | 0.30 - 0.10 | 0.14 |

*FIG. 11*

FILTER COMPONENTS, FILTERS, SMOKING ARTICLES, AND RELATED METHODS, ALL FOR THE CONTROLLED DELIVERY OF AEROSOLS

CROSS-REFERENCE TO RELATED APPLICATIONS

This application is a divisional of U.S. patent application Ser. No. 14/478,854 filed Sep. 5, 2014, which claims the benefit of U.S. Provisional Application No. 61/874,273 filed Sep. 5, 2013, both of which are hereby incorporated by reference as though fully set forth herein.

BACKGROUND OF THE INVENTION a. Field of the Invention

The instant invention relates to smoking articles. More specifically, the instant invention relates to cigarettes.

b. Background Art

In 2005, the European Commission established maximal values for "tar" (10 mg), nicotine (1 mg), and carbon monoxide (CO; 10 mg) per cigarette or "10-1-10," as measured by the International Organization for Standardization (ISO) method, from 1 Jan. 2004. This is part of a trend of lower product yield for all smoke compounds delivered in the cigarette that entails developing new cigarette designs of lower yields while maintaining product taste and acceptability.

It is well known that smoking articles, particularly conventional filtered or unfiltered cigarettes, provide an increasing per puff yield of particulate matter ("puff-to-puff yield") as the cigarette is smoked. In the past, high-efficiency filters and air dilution have been used to provide a lower total yield of particulate matter in the so-called "low tar" and "ultra-low tar" cigarettes now available in the marketplace. However, manufacturers find that high-efficiency filters significantly increase the pressure drop of the cigarette and decrease yield, especially in the first few puffs of the cigarette.

Likewise, air dilution helps to reduce the pressure drop somewhat, but also further reduces the per puff yield in the first few puffs. In combination, high-filtration efficiency and air dilution configured in the conventional way in a cigarette not only produces the desired lower total yield, but also produces an undesirable per puff yield or puff profile of little yield in the first few puffs and a high yield in the final few puffs. The puff profile of this type of configurations is perceived by the smoker of a cigarette as of inconsistent taste characteristics, i.e., little or no taste in the first few puffs and a harsh and overbearing taste in the final few puffs.

The art has attempted to address this problem in several ways as discussed below. The proposed solutions, however, lack the ease of manufacturing required to scale up commercialization of tar-controlled delivery products.

For example, U.S. Pat. No. 8,240,315 B2 teaches about a smoking article that provides lower amounts of total particulate matter in a latter portion of its puff count. The smoking article includes a cylinder of smoking material, a combustible hollow tube within the cylinder of smoking material, and a heat sink at a downstream end of the hollow tube. The smoking article also includes a filter system attached to the cylinder of smoking material having a sorbent material and at least one downstream segment of filtering material.

U.S. Pat. No. 8,235,057 B2 teaches about a smoking article which includes a tobacco rod adapted to produce mainstream smoke, and a filter having an upstream end and a downstream end, wherein the filter is arranged to receive mainstream smoke at the upstream end. The filter includes a tubular segment open at the downstream end thereof and a flow restrictor contained within the tubular segment. The filter is attached to the tobacco rod with tipping paper and includes an air-admissible ventilating zone at a location between the upstream end and the downstream end of the filter.

United States patent application publication no. 2008/0216851 A1 proposes to include a smokable filler of a smoking article with a high aerosol former content and a filter. Preferably, the smokable filler includes about 4 wt. % glycerin to about 35 wt. % glycerin. The filter includes a cylindrical tube attached to the tobacco rod with tipping paper, a first filter segment at a location along said cylindrical tube adjacent and in a downstream relation to said tobacco rod, and a flow restricting filter segment at a location adjacent and in a downstream relation to the first filter segment. In an embodiment, the filter also includes a cavity adjacent and in a downstream relation to the flow restricting filter segment, and a ventilation zone at a location along the cavity including perforations that extend through the tipping paper and the cylindrical tube. Preferably, the ventilation zone is in a downstream relation to the flow restricting filter segment.

United States patent application publication no. 2007/0186945 A1 teaches about a smoking article, which provides lower amounts of total particulate matter in a latter portion of its puff count, which includes a cylinder of smoking material, a combustible hollow tube within the cylinder of smoking material, and a heat sink at a downstream end of the hollow tube. The smoking article also includes a filter system attached to the cylinder of smoking material having a sorbent material and at least one downstream segment of filtering material.

U.S. Pat. No. 5,435,326 proposes a smoking article which has a controlled yield of wet particulate matter and a method of making a smoking article with predetermined total and per puff yields of wet particulate matter. The smoking article has a tobacco rod connected to an air ventilated compound filter having two abutted filter segments, a rod end segment with a passage therethrough and a mouth end segment. The pressure drop of the abutment interface between the segments is selected to be in a range of from about 10 mm to about 100 mm water gauge. According to this patent, the total pressure drop of the filter including the interface and the amount of air dilution can be selected to provide a smoking article with a level per puff yield or a decreasing per puff yield.

Furthermore, U.S. Pat. No. 4,972,853 teaches about a cigarette filter rod element that includes an axially-extending barrier tube of micro-fine fibers with a diameter of between 0.5 and 10 microns and located so that at least part of the gas flow passes through the wall of said barrier tube. U.S. Pat. No. 4,942,887 teaches about tobacco containing cigarette filter plugs that comprise strands of tobacco material which are bound with an activated binding agent. According to the '887 patent, the filter-plugs exhibit good firmness and integrity, and provide cigarettes exhibiting a unique tobacco taste. Filter plugs are prepared by forming an intimate admixture of tobacco material and binding agent, forming rods, and activating the binding agent. U.S. Pat. No. 4,109,666 teaches about a filter tipped cigarette that also includes a cylindrical tobacco section and a cylindrical filter axially aligned therewith. The filter is comprised of an axially aligned tube extending from said tobacco section, a layer of filter material positioned circumferentially about said tube, and a diffuser adjacent an end of the tube for dispersing the smoke received from the tube prior to entering the smoker's mouth.

One of the major drawbacks from what is described in the '326 patent noted above is a limitation in filter construction which is relegated to 31 mm filter designs based on the components identified to achieve relative consistency from puff to puff. Specifically, the prior art teaches that at least a 17 mm cellulose acetate (CA) filter segment equipped with a 1.0-1.5 mm tube is necessary to combine with a traditional cellulose filter segment to achieve a desired effect. In addition, the prior art teaches that interfacial abutment pressure between the "functional" filter segment and the standard cellulose acetate must be greater than traditional pressures achievable on standard filter rod making equipment; and, therefore, the ability to manufacture functional filters at commercially relevant speeds is unlikely. To that end, the basis of the purported invention of the '326 patent relies on the fact the CA segment containing the tube be sufficiently long so that the primary flow of mainstream smoke travels through the 1.0-1.5 mm tube and not through the surrounding CA material. This is due to the pressure drop differences between the tube and the CA material, requiring long filter segments to achieve the effect. When the pressure drop difference between the capillary tube and the surrounding material are similar, the effect cannot be achieved. Therefore, shorter filter constructions such as 27 mm, 25 mm, and 21 mm filters are not possible using what is described in U.S. Pat. No. 5,435,326.

The foregoing discussion is intended only to illustrate the present field and should not be taken as a disavowal of claim scope.

BRIEF SUMMARY OF THE INVENTION

It is desirable to be able to provide methods to design and fabricate filter elements, compound filter constructions, and cigarette designs to manufacture smoking articles of tar yield delivery such that the tar yields of the first few puffs are perceived by the smoker similarly to the last few puffs during smoking. Furthermore, it would be desirable to provide such cigarettes with filter elements that can be easily manufactured using conventional manufacturing equipment and methods that allow broader filter design flexibility and potential application to 10:1:10 products wherein it may be possible to achieve a higher tar, full flavor taste experience in a reduced tar cigarette.

In various embodiments, a description of the methods of fabrication of filter elements for the infinite-pressure-drop and very-high-pressure-drop filter rods is provided.

In at least one embodiment, a method of making infinite-pressure-drop filter rods for a smoking article, particularly a cigarette, comprises extruding a plastic resin into a tube by using a die design with a pin of a desirable diameter to form a hollow string, drawing the hollowed string, cooling the drawn hollowed string in a cooling trough, and cutting the drawn and cooled hollowed string into filter rods.

In addition to the various methods described herein, the invention also comprises the resulting filter elements, filters, and cigarettes.

The foregoing and other aspects, features, details, utilities, and advantages of the present invention will be apparent from reading the following description and claims, and from reviewing the accompanying drawings.

BRIEF DESCRIPTION OF THE DRAWINGS

FIG. 2 is a table of design parameters and performance of various embodiments compared to traditional filter controls.

FIG. 11 shows the filter rods attributes for the filter rod element of embodiments of this invention.

DETAILED DESCRIPTION OF THE INVENTION

The embodiments of the invention described herein discloses a filter construction and design using a non-CA based material of infinite pressure drop (e.g. an impermeable material) as a filter segment contained in 27 mm and 21 mm filter designs wherein the puff-to-puff variation is essentially zero over the course of smoking. Specifically, the invention uses a 5-12 mm long foamed polyethylene (PE) or polypropylene (optionally CA) filter segment that has an infinite pressure drop containing a 1.5-2.0 mm diameter axial cavity that allows mainstream smoke to pass through unobstructed, wherein the mainstream smoke is filtered in a traditional CA filter segment located at the mouth-end of a cigarette further equipped with air dilution holes. An additional benefit of the foamed PE filter segment is a single piece in contrast to a CA filter segment containing a tube, and the foamed PE filter segment can be extruded using high-volume production equipment commonly found in the plastics industry.

It would be desirable, therefore, to provide methods to fabricate and design filter elements, compound filter constructions, and cigarettes designs to manufacture smoking articles of tar yield delivery such that the tar yield of the first few puffs are perceived by the smoker similarly to the last few puffs during smoking. Furthermore, it would be desirable to provide such cigarettes with filter elements that can be easily manufactured using conventional manufacturing equipment and methods that allow broader filter design flexibility and potential application to 10:1:10 products wherein it may be possible to achieve a higher tar, full flavor taste experience in a reduced tar cigarette.

Figure 1:
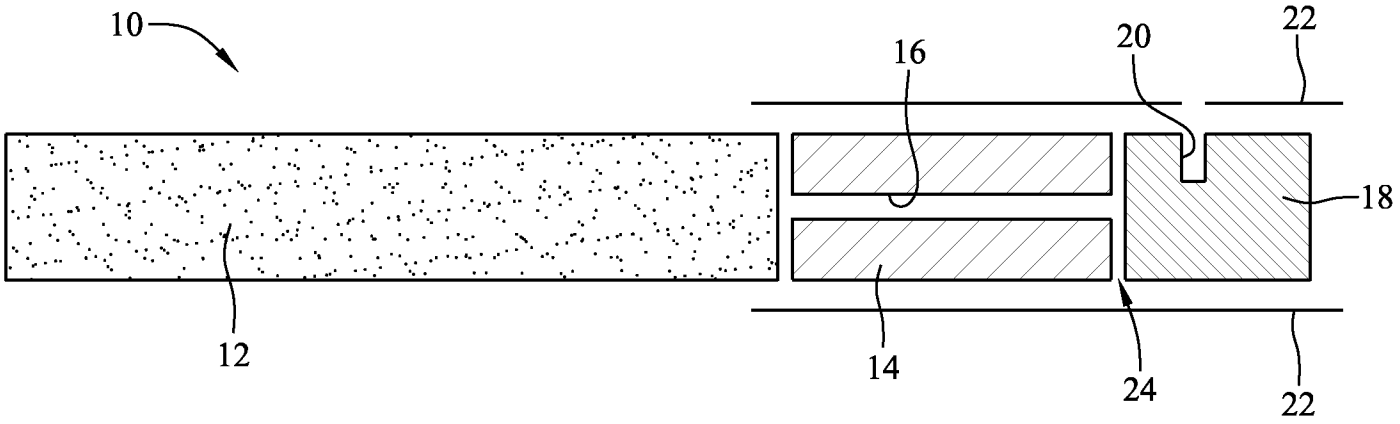
FIG. 1 is cross-sectional view of a cigarette according to one embodiment of the invention.

FIG. 1 generally illustrates an air ventilated cigarette 10 formed with a regular tobacco column 12, a pressure drop element (i.e., axial cavity filter element) 14 including hollow channel 16 and a solid, high-density mouth piece (e.g. a high permeability, low pressure drop material) 18. The air ventilation holes 20 can be placed in any location along the filter zone to control the organoleptic profile of the smoking article as well as the filter performance. Additionally, the filters can be built with a one or more microcapillary or tubular, axially-located cavity structures. Tipping wrapper 22 is used to hold the pressure drop element 14 and the high-density mouth piece 16 in engagement along an abutment interface 24.

FIG. 2 shows non-limiting examples of filter design constructions that embody this invention. More specifically, FIG. 2 provides examples of design parameters and performance of the filter design according to this invention as compared with traditional filters. The examples shown in FIG. 2 were built either using polyethylene hollow rods (e.g. an impermeable, infinite pressure drop material) or polypropylene inserted into a commercial cellulose acetate filter tow rod segment treated with a density enhancer (e.g. a low permeability, very high pressure drop material).

In the art, the term "tar" means total particulate matter of the mainstream smoke after subtracting water and nicotine. It is measured according to a standard procedure under standard machine smoking conditions. Another nomenclature that is used to describe cigarette strength is total particulate matter (TPM). This is usually measured by collecting the particulate in filter pads while machine smoking the cigarette, and will be preferably used herein.

Figure 3:
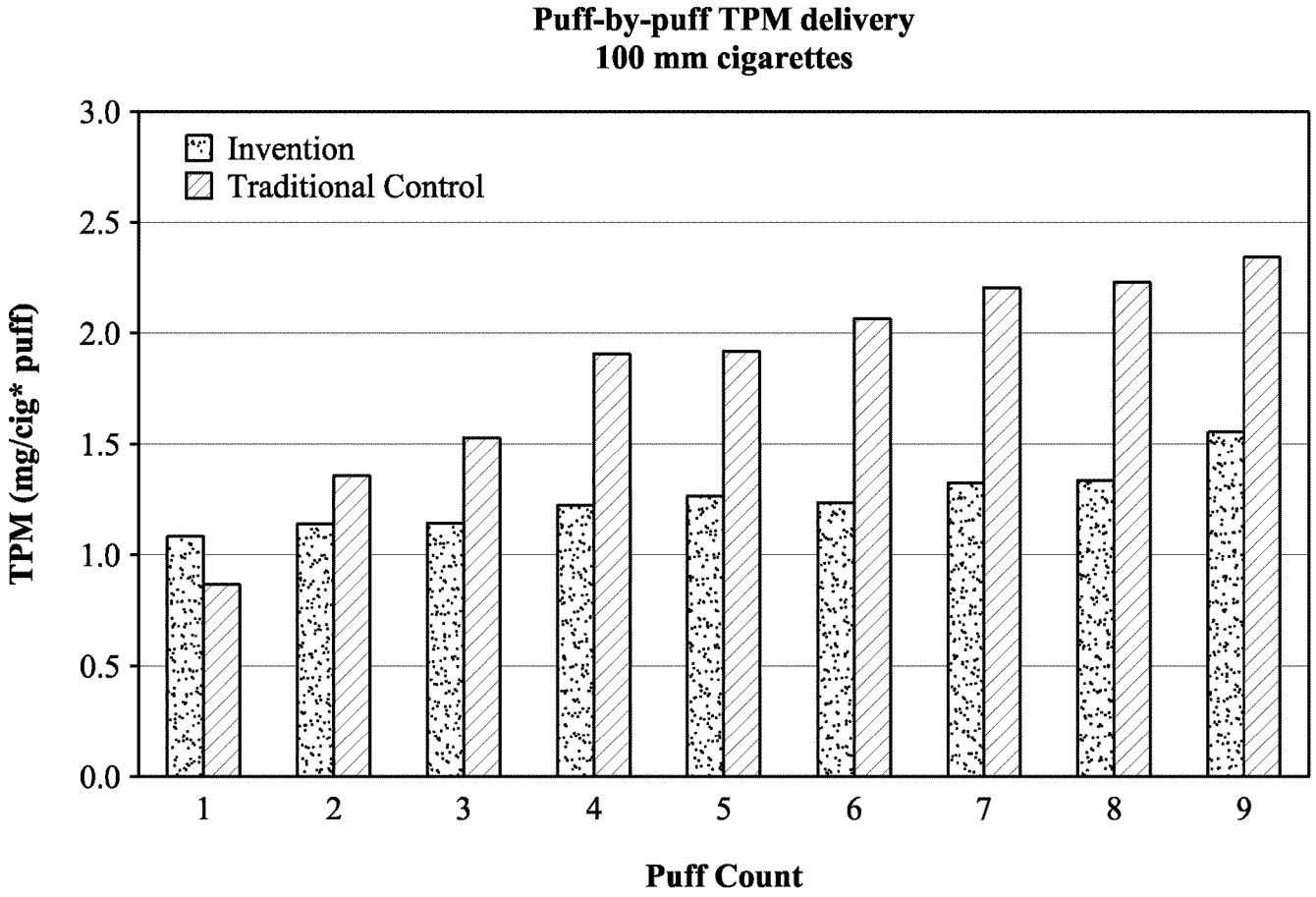
FIG. 3 depicts tar delivery for a 100 mm cigarette constructed according to an embodiment of this invention using an infinite pressure drop material with a 2.0 mm inner diameter (ID) filter segment cavity compared to a traditional cellulose acetate filtered cigarette.
Figure 4:
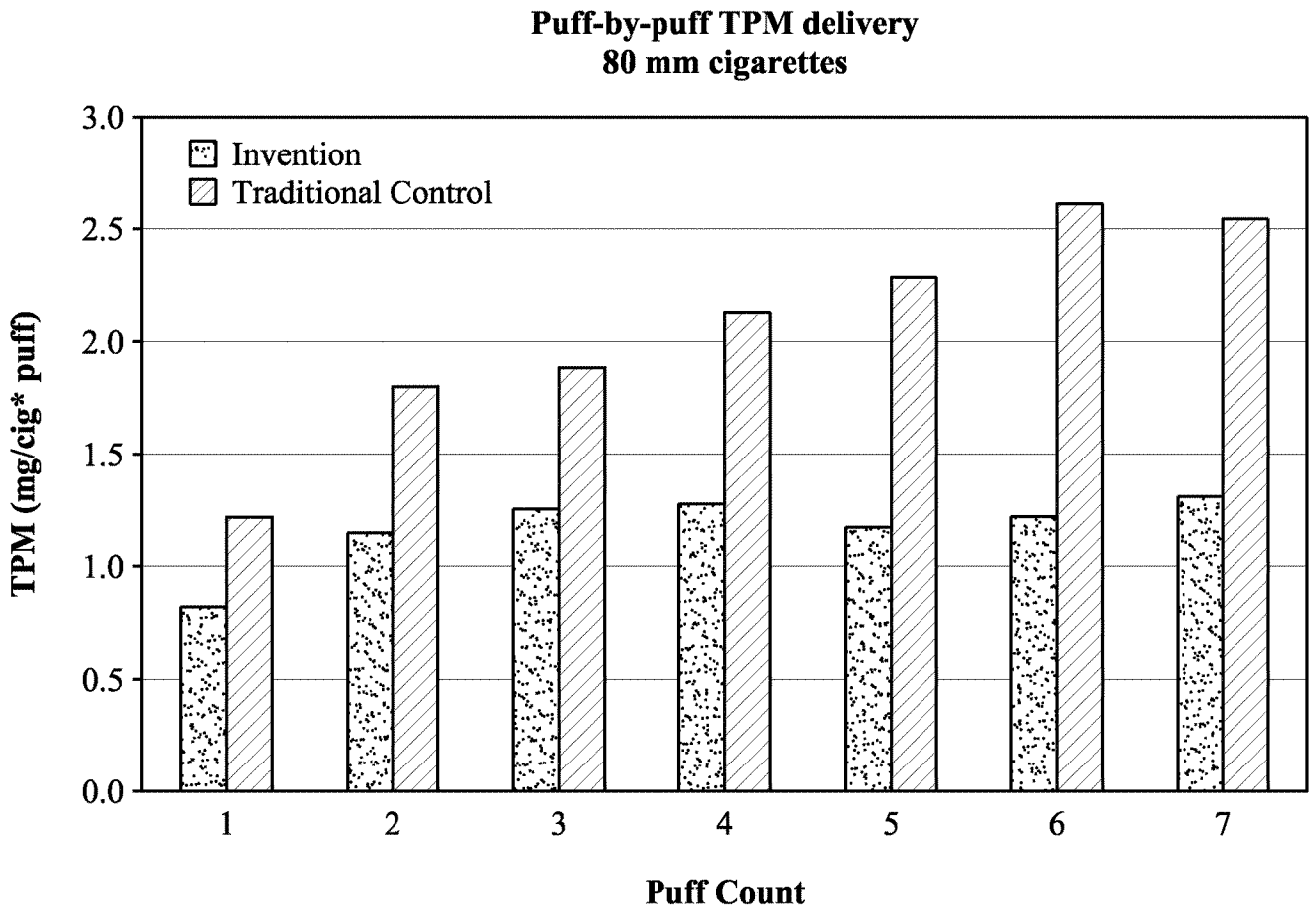
FIG. 4 depicts tar delivery for an 80 mm cigarette constructed according to an embodiment of this invention using an infinite pressure drop material with a 2.0 mm ID filter segment cavity compared to a traditional cellulose acetate filtered cigarette.

TPM or tar delivery consistency is measured as the regressed slope for delivered tar between puff 2 and puff 8. A regressed slope of zero signifies constant tar delivery during smoking. As the slope progresses toward "zero," the tar delivery constancy increases. The examples of the invention presented herein show that this invention reduces that slope toward zero value and increases its efficiency for delivery tar consistency. For instance, FIGS. 3 and 4 show the TPM delivery during smoking for axial filter designs of this invention using infinite pressure drop materials, such as polymers, for 100 and 80 mm cigarette constructions, respectively. In both cases, the TPM profile of cigarette prototypes embodying this invention are 'flatter,' indicating a more consistent delivery of TPM from the first few puff to the last few puffs.

Additional embodiments of this invention comprise empirical relationships between % air dilution and its location, tow density and hollow inner diameter insert and its length, mouth piece density, that affect the consistency of the delivered yields as measured by the slope between the initial few puffs and the latest few puffs. These relationships are useful to design air diluted cigarettes with more consistent tar delivery at equivalent "tar" level of commercially available ones. It is expected that the organoleptics properties of these cigarettes will preferentially benefit a more balanced smoking experience.

Figure 5:
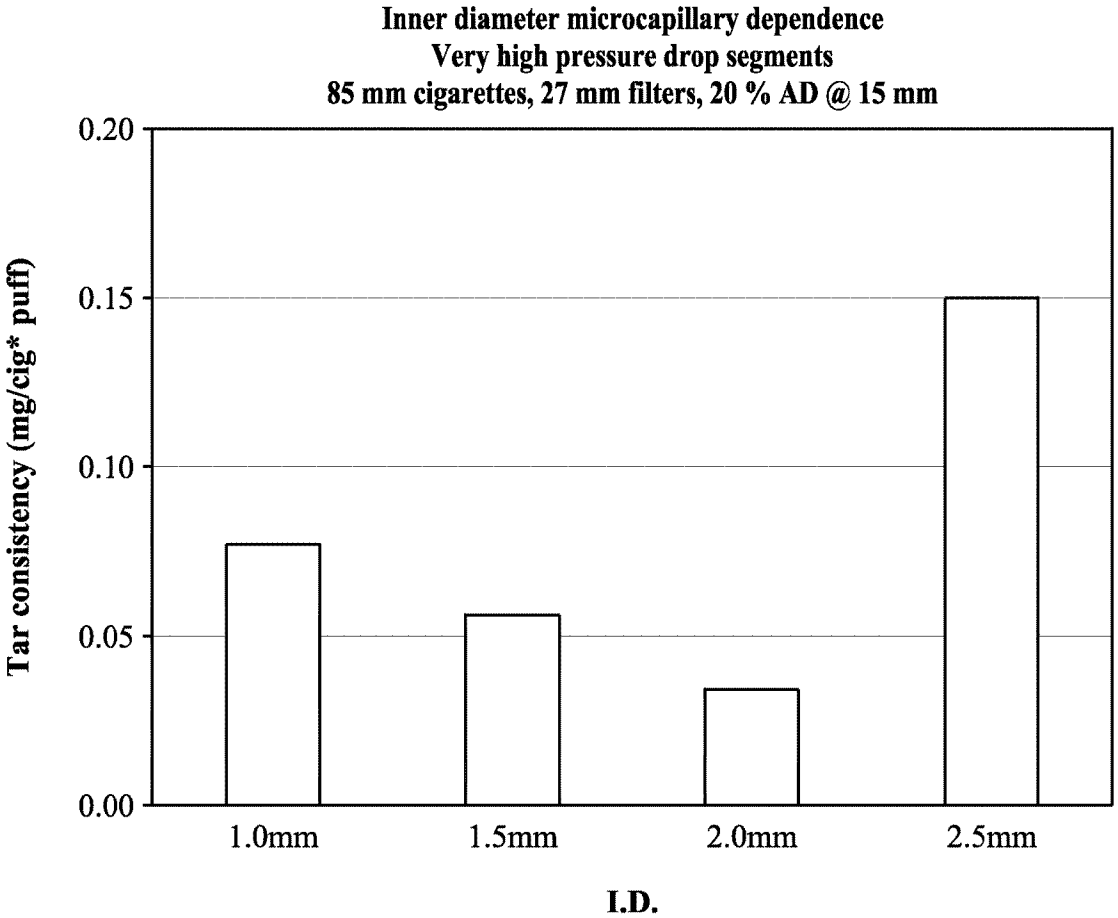
FIG. 5 shows tar consistency of cigarette prototypes built according to embodiments of this invention with different inner diameters.

FIG. 5 shows that tar consistency depends on the inner diameter of the hollow tube or microcapillary used in the axial cavity filter element. More specifically, FIG. 5 shows an improvement on tar consistency at small IDs. The data shows a reduction of the tar slope with a minimum slope at about 2.0 mm of ID for these particular prototype designs. Smoking article manufacturers can, therefore, design cigarettes with higher consistency by judiciously using the inner diameter as a controlling variable.

Figure 6:
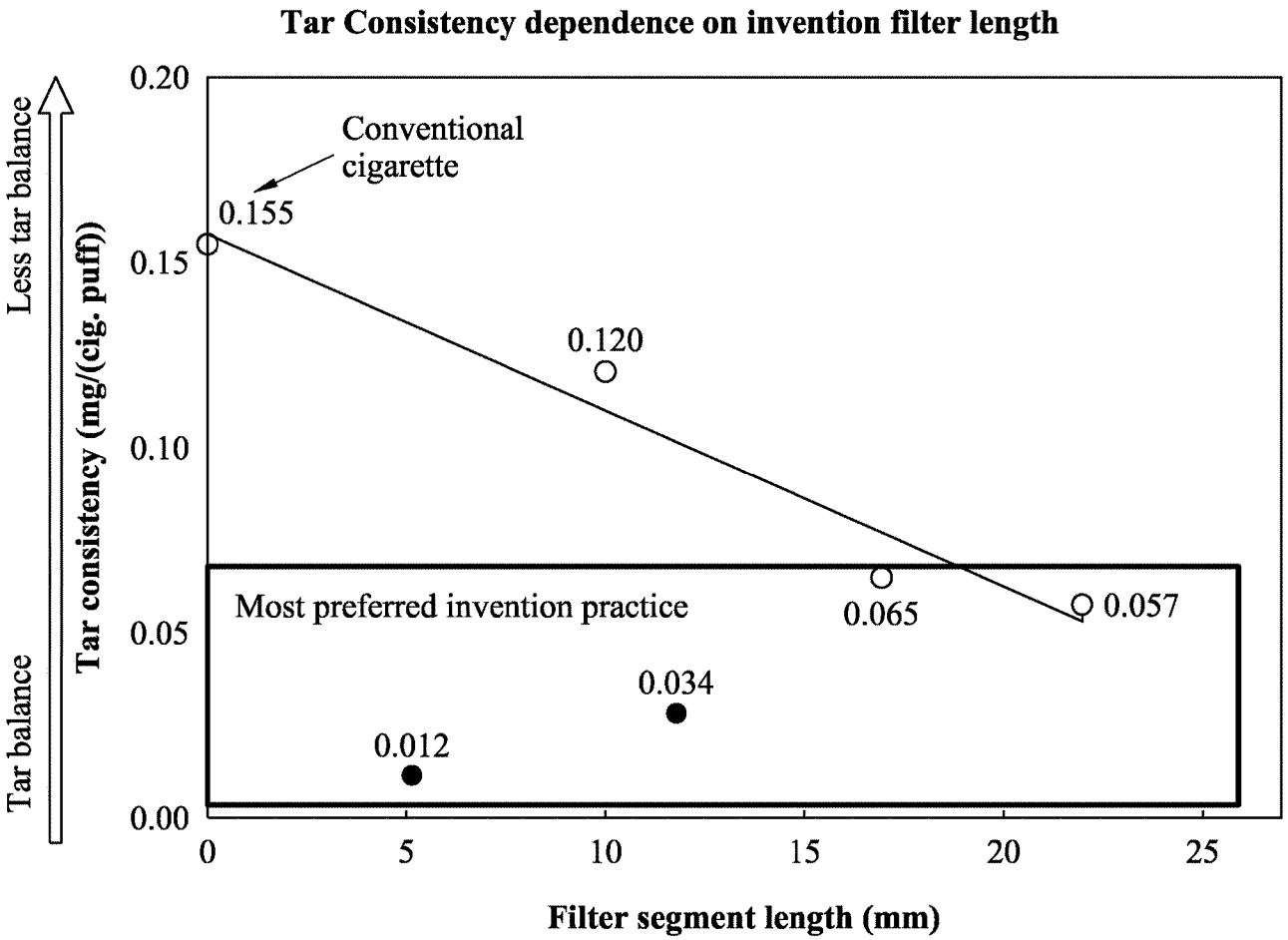
FIG. 6 shows tar consistency of cigarettes built according to embodiments of this invention.

FIG. 6 shows that tar consistency depends on the length of the filter element at a given % of air dilution and inner diameter of the hollow tube or microcapillary used in the filter element. More specifically, FIG. 6 shows an improvement on tar consistency as very-high-pressure filter segment increases in length (open circles) as well as tar consistency for infinite pressure drop segment-built (closed circles) cigarettes. The data shows a reduction of the tar slope for cellulose acetate-constructed prototype designs while the infinite pressure drop cigarette designs have near maximum tar consistency, which it not affected by the length of the segment. Thus, in accordance with this invention, the pressure drop further increases as the filter element becomes longer with a limit given as the infinite pressure drop element. Smoking article manufacturers can therefore design cigarettes with higher consistency by judiciously using the filter element length in conjunction with appropriate air dilution and mouth piece of this invention as a controlling variable.

Figure 7:
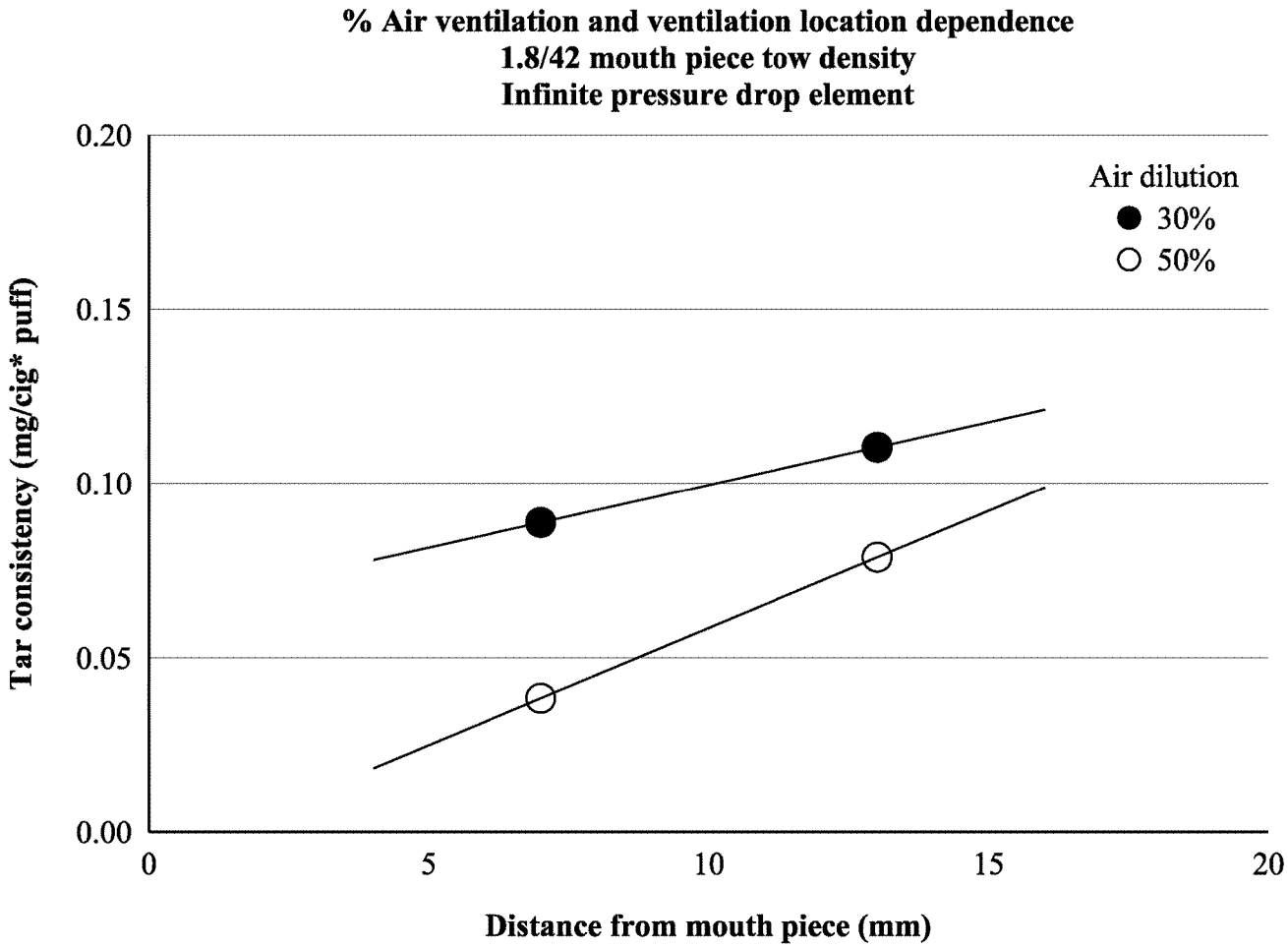
FIG. 7 shows the effect of air ventilation technology on tar consistency for infinite-pressure-drop element cigarette prototypes built according to embodiments of this invention.

FIG. 7 shows that tar consistency depends on both the position of the air ventilation holes as well as the amount of air ventilation (%) in the practice of embodiments of this invention. More specifically, FIG. 7 shows tar consistency improvement as the distance between the ventilation holes to the mouth piece end at various level of air ventilation in infinite-pressure-drop element filter designs decreases. The data shows a reduction of the tar slope for these particular prototype designs as well as demonstrating that there is an interaction between the amount of air ventilation and where it happens. It is possible to explain this behavior by considering that air ventilation affect changes on filtration efficiency of the filters and, therefore, also the pressure drop would increase further as the localized cooler air interacts with the smoke stream. Smoking article manufacturers can therefore design cigarettes with higher tar consistency by judiciously using air ventilation technology as a controlling variable.

Figure 8:
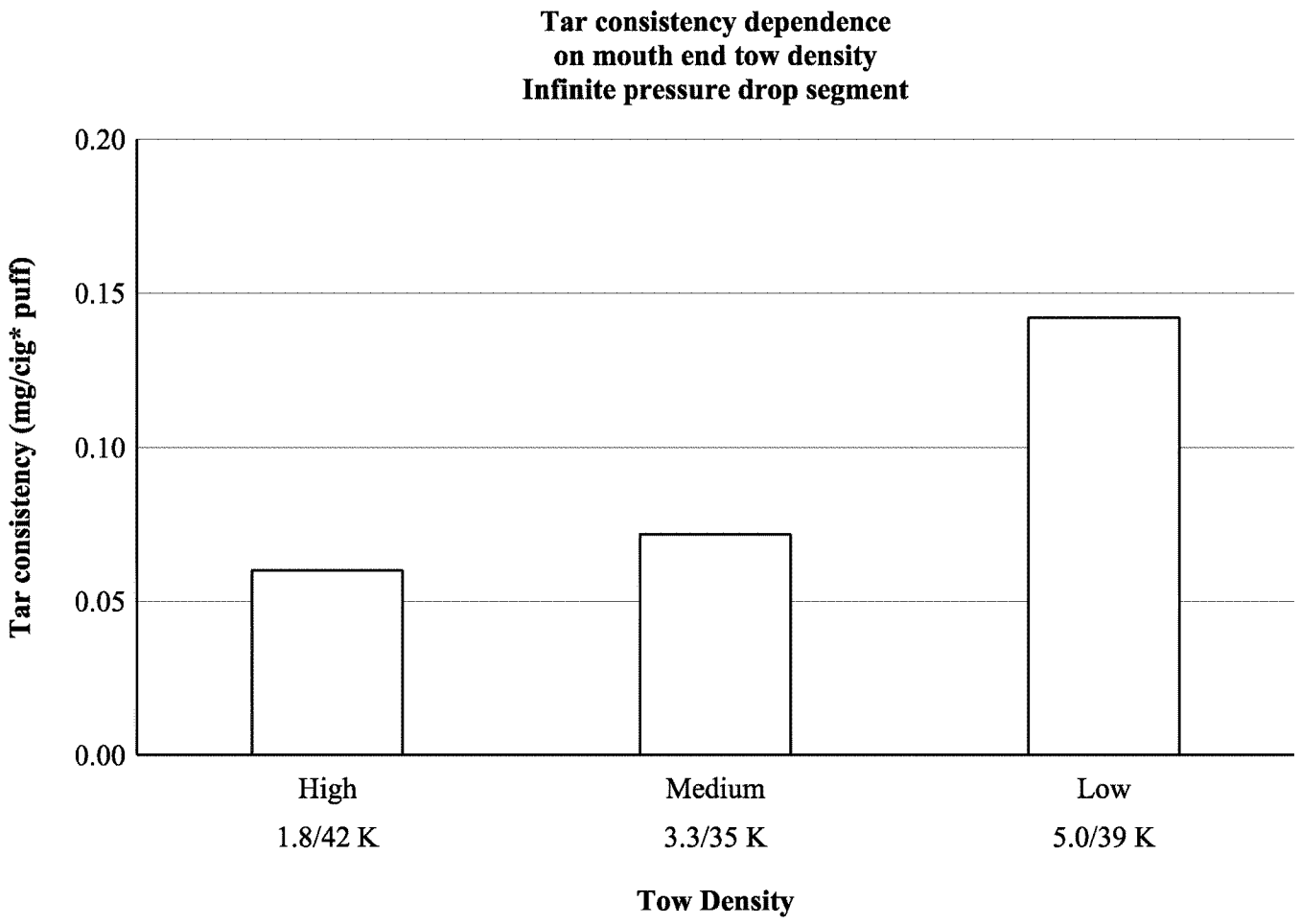
FIG. 8 shows the effect of the tow density of the mouth piece on tar consistency for infinite pressure drop element prototypes built according to embodiments of this invention into 100 mg cigarette prototypes.

FIG. 8 shows that tar consistency also depends on the tow density of the mouth piece used in the filter design. More specifically, FIG. 8 shows tar consistency improvement as cigarette prototypes are built with higher tow density in the mouth piece in infinite-pressure-drop element filter designs. The data shows a reduction of the tar slope for these particular prototype designs. Thus, in accordance with this invention, a higher tow type would increase faster in filtration efficiency of the filters during smoking, and therefore also the pressure drop would increase further as the localized cooler air interact with the smoke stream. It would foul the zone area where the mouth piece and the smoke stream interact strongly, "focusing effect." Smoking article manufacturers can therefore design cigarettes with higher tar consistency by judiciously using high-density tow in the mouth piece as a controlling variable.

Methods of Construction of Filter Elements

Following are descriptions of possible methods of fabricating the infinite-pressure-drop filter element and very-high-pressure filter rods.

A. Infinite-Pressure-Drop Filter Element

Figure 9:
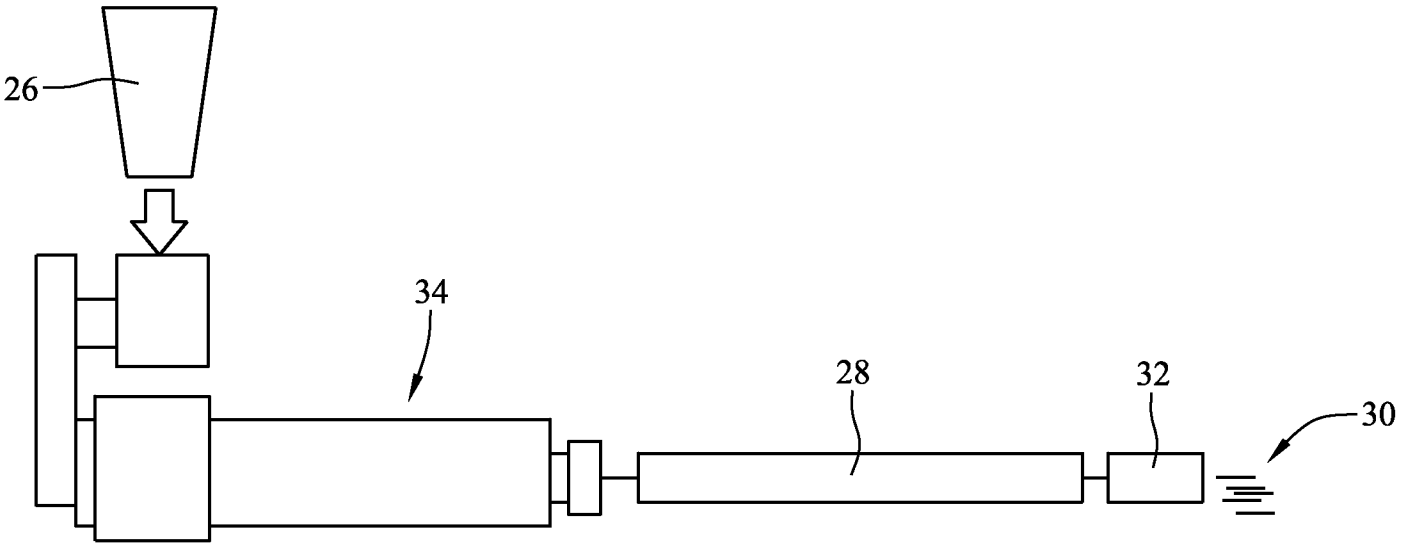
FIG. 9 shows a schematic for the fabrication of infinite pressure drop filter rods using a conventional twin extruder.

A method to fabricate a filter rod for a smoking article according to an embodiment of this invention comprises extruding a plastic resin from hopper 26 into a tube by using a die design with a pin of a desired diameter held within a die holder to form a hollow string. The hollowed string is then drawn and cooled in a cooling trough 28 and, finally, cut into filter rods 30 using a take-up and cut-off assembly 32. FIG. 9 schematically depicts this method of fabricating a filter rod using a conventional twin extruder 34.

The practice of embodiments of this invention is not limited to polyolefin resins, but it is inclusive of other melt extrudable polymeric resins appropriate to manufacture microcapillary and hollow tubes such as, for example, foamed polyethylene, polypropylene, nylon, polycarbonate, and cellulose acetate.

B. Very-High-or-Infinite-Pressure-Drop Filter Elements

Figure 10:
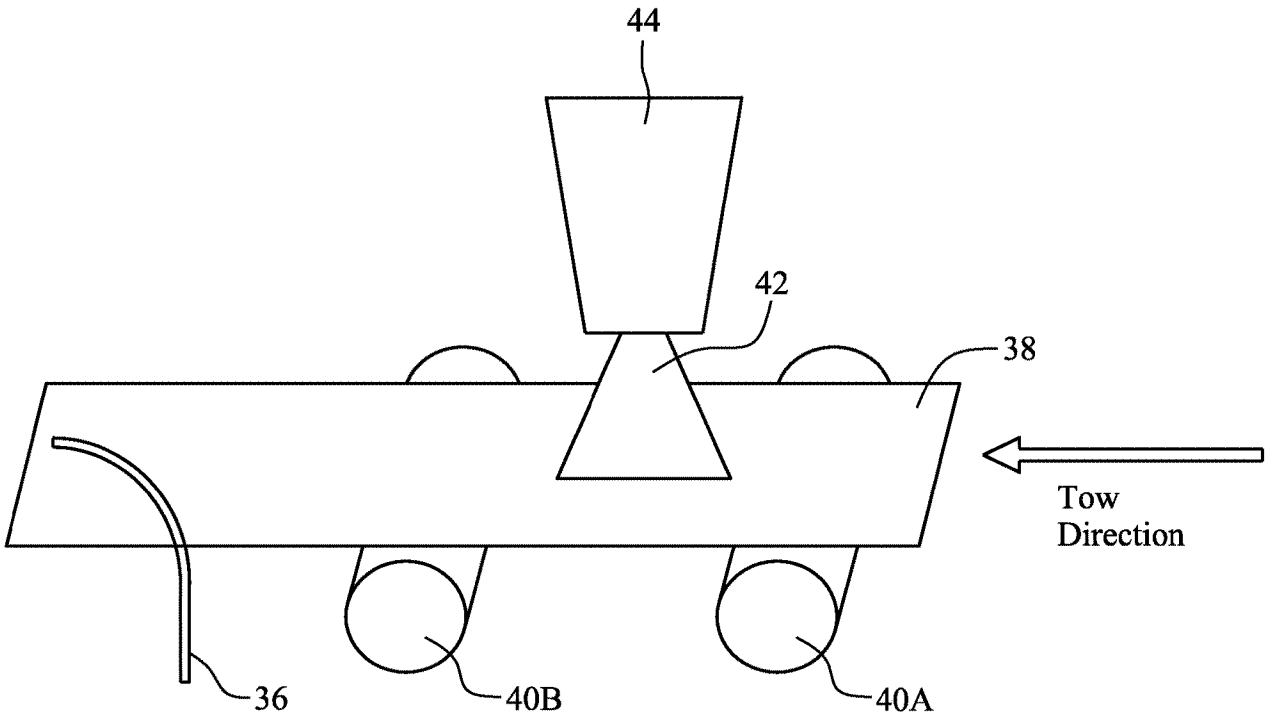
FIG. 10 shows a schematic representation of the incorporation of tubing onto a moving tow band used for filter rod making.

A method to fabricate the rod according to embodiments of this invention comprises incorporating plastic microcapillary 36 or tubes into cellulose acetate filter rods to form hollow rods, e.g. a tube-in-tow design. This has been accomplished by inserting the microcapillary 36 onto the path of a moving tow band 38 passing over delivery roll 40A and transport roll 40B. FIG. 10 schematically depicts the method employed during filter making using a conventional filter maker. It operates by passing cellulose filament bundles through a plug maker garniture to spread the tow filaments and then wrapping together with paper the tow and the microcapillary 36. The microcapillary 36 is added from a spool into the garniture after the addition of the plasticizer and final conversion into filter rods. However, addition of the tubes can also be added prior to plasticizer addition.

According to embodiments of another aspect of this invention, a tow density enhancer 42 or plasticizers is sprayed by sprayer 44 into the moving tow band 38 to increase the tow density and manufacture the desired tow density. The density enhancer consists of triacetin, polyvinyl acetate, poly acrylic acid, acrylates, and polyvinyl alcohol. In other embodiments the density enhancer consists of solid mineral powder such as calcium carbonate and polymeric powder such as polyethylene, polypropylene, and cellulose acetate. A very high tow density is needed to form very-high-pressure-drop filter segments (e.g. a low permeability material). Furthermore, the practice of embodiments of this invention is not limited to polycarbonate materials, but it is inclusive of other polymeric resins appropriate to manufacture the rods of this invention such as, for example, polyethylene, polypropylene, nylon, and cellulose acetate.

Figure 12:
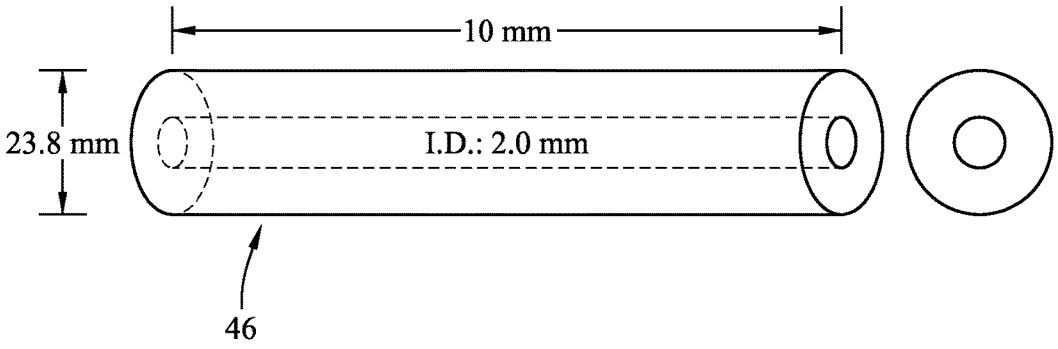
FIG. 12 is a sketch of a typical filter rod and its dimensions.

Using either of the methods described above, it is possible to fabricate filter rods elements suitable to practice embodiments of this invention that have attributes shown in FIG. 11. FIG. 11 shows the working ranges, preferred, and most preferred filter rod characteristics. FIG. 12 schematically depicts an example of the dimension of typical rods 46 manufactured using the methods of this invention.

Smoking Procedure

The tested cigarettes were tested by smoking them using the following procedure: 2 second smoking puff duration, 58 second wait between puffs, and 35 ml puff volume in a smoking machine. The particulate was collected on a Cambridge filter pad. Each Cambridge filter pad was weighed in its holder before and after smoking to calculate TPM or "tar." A Borgwaldt RM 20/CS smoking machine with a twin-filter attachment was used for smoking the cigarettes. The cigarettes were smoked to a butt length 3 mm from the tipping paper.

Figure 13:
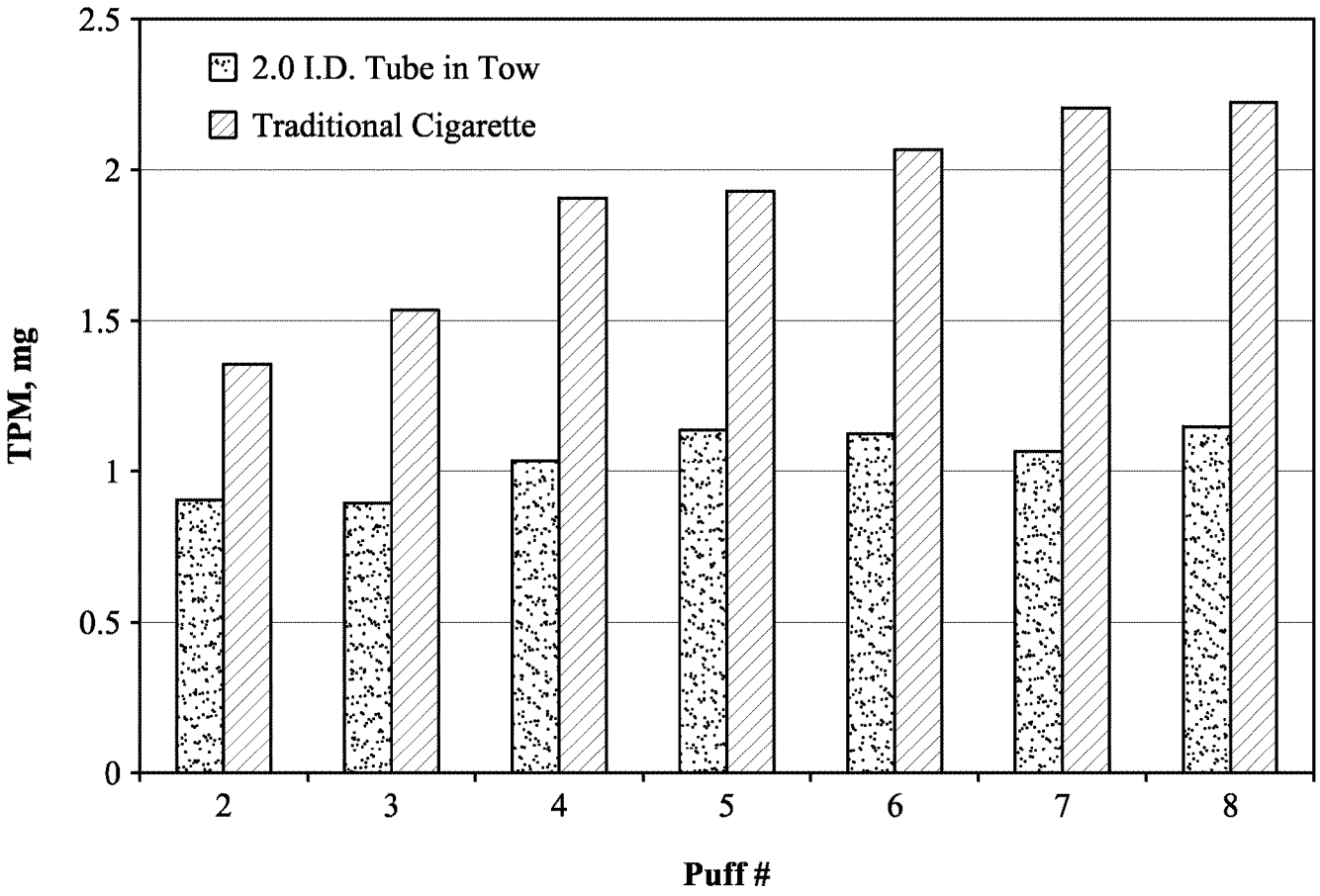
FIG. 13 depicts tar delivery for a cigarette constructed according to an embodiment of this invention using a tube-in-tow design with a 2.0 mm inner diameter (ID) filter segment cavity compared to a traditional cellulose acetate filtered cigarette.

FIG. 13 depicts tar delivery for a cigarette constructed according to an embodiment of this invention using a tube-in-tow design with a 2.0 mm inner diameter (ID) filter segment cavity compared to a traditional cellulose acetate filtered cigarette. As discussed, TPM or tar delivery consistency is measured as the regressed slope for delivered tar between puff 2 and puff 8. A regressed slope of zero signifies constant tar delivery during smoking. As the slope progresses toward "zero," the tar delivery constancy increases. The examples of the invention presented herein show that this invention reduces that slope toward zero value and increases its efficiency for delivery tar consistency. For instance, FIG. 13 shows the TPM delivery during smoking for axial filter designs of this invention using a tube-in-tow design, such as a polymeric tube inserted into a hollow CA body treated with a density enhancer, for 100 and 80 mm cigarette constructions, respectively. In both cases, the TPM profile of cigarette prototypes embodying this invention are 'flatter,' indicating a more consistent delivery of TPM from the first few puff to the last few puffs.

Figure 14:
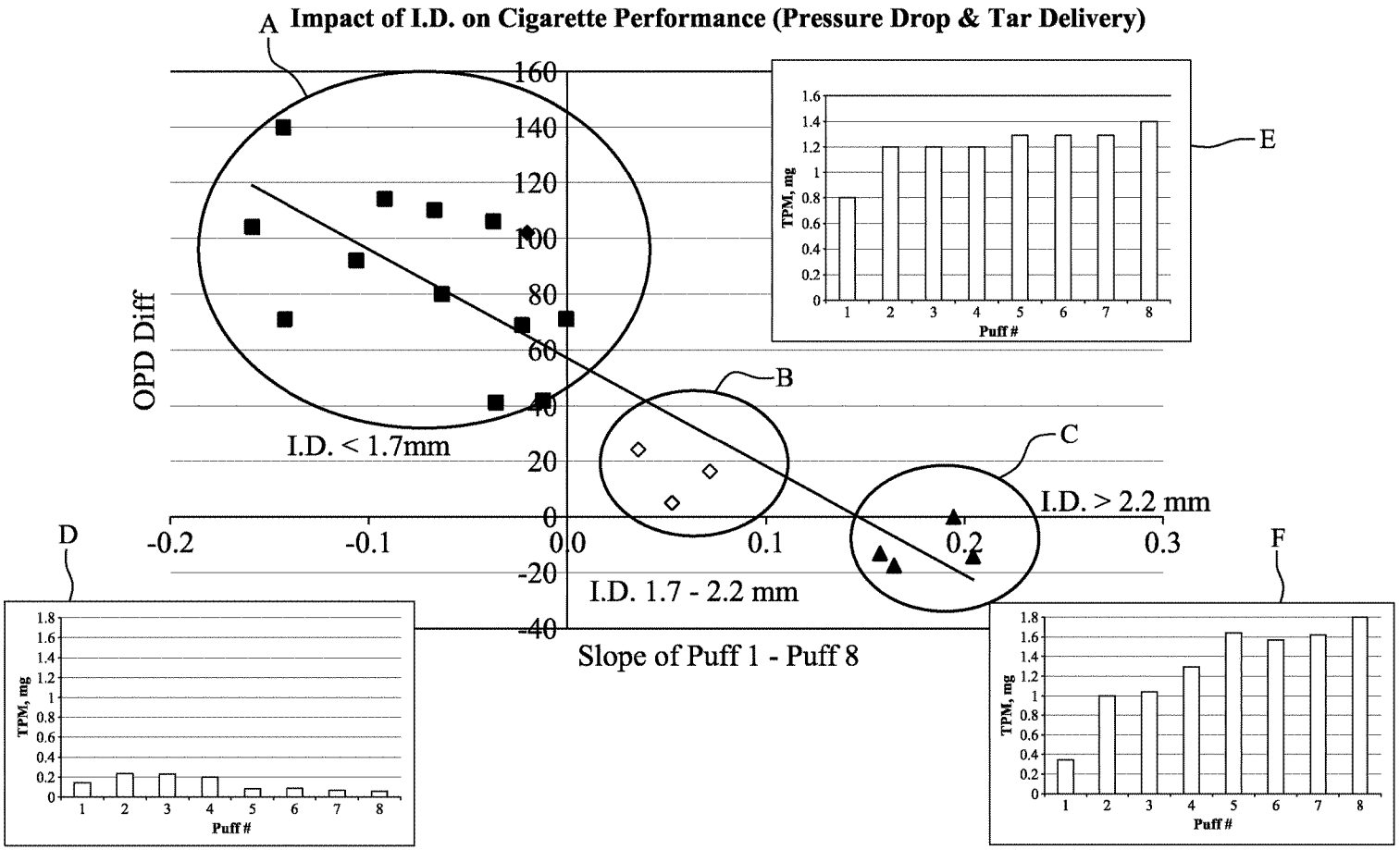
FIG. 14 shows the pressure differential between puffs versus the slope of the puffs for air ventilated cigarettes having hollow channels of increasing inner diameters.

FIG. 14 shows the pressure differential of the filter between the first and last puffs versus the slope of the puffs for air ventilated cigarettes having hollow channels of differing inner diameters. As shown at call out A, having a hollow channel inner diameter of 1.7 mm or less results in mostly negative slope of puffs corresponding with high levels of puff differentials between the beginning and final puffs. Such values are indicative of a small tube channel that results in fouling of the mouth end filter element, thereby resulting in large pressure differentials as the mouth end filter element becomes fouled with each additional puff. Thus, a negative slope of puff results as the TPM decreases from puff number 1 to puff number 8, as shown, for example, in box D. Such characteristics result in undesirable, inconsistent smoking experiences.

As shown at call out B, having a hollow channel inner diameter of 1.7 mm to 2.2 mm results in a slightly positive slope of puff corresponding with acceptable levels of puff differentials between the beginning and final puffs. Such values are indicative of a tube channel that results in less fouling of the mouth end filter element as compared to smaller diameters, thereby resulting in acceptable pressure differentials as the mouth end filter element becomes fouled with each additional puff. Thus, a slightly positive slope of puff results as the TPM decreases from puff number 1 to puff number 8, as shown, for example, in box E. Such characteristics, typical of cigarette filters of the present invention (e.g. infinite pressure drop hollow tubes and tube-in-tow designs) result in desirable, consistent smoking experiences.

As shown at call out C, having a hollow channel inner diameter of 2.2 mm or greater results in mostly positive slope of puff corresponding with low levels of puff differentials between the beginning and final puffs. Such values are indicative of a large tube channel that result in minor fouling of the mouth end filter element, thereby resulting in only small pressure differentials as the mouth end filter element becomes fouled with each additional puff. Thus, a largely positive slope of puff results as the TPM decreases from puff number 1 to puff number 8, as shown, for example, in box F indicating an undesirable puff profile. Such characteristics, typical of conventional cigarette filters, result in undesirable, highly inconsistent smoking experiences, contrary to the desired experiences indicated by call out B and box E.

FIG. 14, in view of the forgoing, demonstrates that rod end filter segments having interior passages can result in both small puff differentials and low slope of puffs when combined with very high or infinitely high pressure differential materials of the rod end filter segment. Furthermore, the diameter of the passage can be increased beyond previously used methods of the prior art. For example, the diameter of the interior passage can be increased without regard to an abutment pressure between the rod end filter segment and a solid mouth end filter segment if the material of the rod end filter segment has a very high or infinitely high pressure drop (e.g. has low permeability or is impermeable).

Smoking articles produced according to the methods and designs disclosed herein have tar yield deliveries such that the tar yield of the first few puffs are perceived by the smoker similarly to the last few puffs during smoking. Furthermore, the single piece, infinite pressure drop rod end segments and tube-in-tow designs are easy to manufacture, thereby facilitating increased production rates. For example, the single piece, infinite pressure drop segments can be extruded using conventional systems. Additionally, in any of the designs disclosed herein, the abutment pressure between the mouth end filter segment and the rod end filter segment is low enough to not require sophisticated, costly and slow assembly techniques.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of all embodiments.

Reference throughout the specification to "various embodiments," "some embodiments," "one embodiment," or "an embodiment," or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It will be appreciated that joinder references (e.g., attached, coupled, connected, and the like) are to be construed broadly and may include intermediate members between a connection of elements. As such, joinder references do not necessarily infer that two elements are directly connected to each other. Changes in detail or structure may be made without departing from the spirit of the invention as defined in the appended claims.

What is claimed is:

1. A filter for a smoking article comprising a mouth end filter segment and a rod end filter segment, the mouth end filter engaging the rod end filter segment along an abutment interface, said rod end filter segment having an axial cavity extending longitudinally therethrough, said axial cavity having an inner diameter between 1.7-2.2 mm, said rod end filter segment comprised of an infinite pressure drop material, and air dilution means disposed in one of said filter segments for admitting ventilating air into said filter.

2. The filter according to claim 1, wherein the total pressure drop of said filter and the amount of ventilating air admitted to said filter being selected to provide a substantially level per puff yield of wet particulate matter from the first puff to the last puff of the smoking article.

3. The filter according to claim 1, wherein said rod end filter segment including said axial cavity is fabricated from said infinite pressure drop material.

4. The filter according to claim 3, wherein said infinite pressure drop material comprises an extruded polymer.

5. The filter according to claim 4 wherein said infinite pressure drop material comprises a polymer foam.

6. The filter according to claim 4, wherein the rod end filter segment has a density in the range of about 0.08 grams/milliliter to about 0.30 grams/milliliter.

7. The filter according to claim 1, wherein a length of said axial cavity is in the range of about 7 mm to about 17 mm.

8. The filter according to claim 1, wherein said air dilution means are disposed in said mouth end filter segment, said air dilution means comprising perforations in the periphery of said mouth end filter segment.

9. The filter according to claim 8, wherein said perforations are disposed within said mouth end segment from about 5 mm to about 15 mm from an exposed end of said mouth end filter segment.

10. The filter according to claim 1, wherein said mouth end filter segment and said rod end filter segment have circumferences in the range of about 23.5 mm to about 24.1 mm.

11. The filter according to claim 1, wherein the total pressure drop difference of the smoking article before and after smoking is no greater than 50 mm water.

12. The filter according to claim 1, wherein the infinite pressure drop material has no permeability.

13. The filter according to claim 12, wherein a length of the rod end filter segment is in the range of about 5 mm to about 12 mm.

14. The filter according to claim 1, wherein the rod end filter segment is fabricated from a cellulose acetate material having a density enhancer.

15. The filter according to claim 14, wherein the density enhancer comprises at least one of triacetin, polyvinyl alcohol, polyvinyl acetate, poly acrylic acid, and acrylates.

16. The filter according to claim 14, wherein the density enhancer consists of solid mineral powder comprising at least one of calcium carbonate and polymeric powder, wherein the polymeric powder comprises at least one of polyethylene, polypropylene, cellulose acetate.

17. The filter according to claim 1, wherein the rod end filter segment comprises a melt extrudable polymeric resin.

18. The filter according to claim 1, wherein the axial cavity and the rod end filter segment are formed as a single unit, wherein the rod end filter segment and the axial cavity are formed by:

extruding a plastic resin into a tube using a die design to form a hollow string, the die design forming the inner diameter of the axial cavity;

cooling the hollow string;

drawing the hollow string; and cutting the hollow string into rod end filter segments.

19. The filter according to claim 17 wherein the extrudable polymeric resin comprises one of polyolefin resins, foamed polyethylene, polypropylene, nylon, polycarbonate, and cellulose acetate.

* * * * *